United States Patent [19]

Sohler

[11] 4,054,079

[45] Oct. 18, 1977

[54] KEYBOARD AND NOTATION SYSTEM

[76] Inventor: Melvin Howard Sohler, P.O. Box 32, Pinos Altos, N. Mex. 88053

[21] Appl. No.: 656,104

[22] Filed: Feb. 9, 1976

Related U.S. Application Data

[63] Continuation-in-part of Ser. No. 557,592, March 12, 1975, abandoned.

[51] Int. Cl.[2] ..... G10C 3/12

[52] U.S. Cl. ..... 84/423; 84/427; 84/428; 84/483 A

[58] Field of Search ..... 84/423, 424, 425, 427, 84/428, 451, 483

[56] References Cited

U.S. PATENT DOCUMENTS

| | | | |
|---|---|---|---|
| 334,484 | 1/1886 | Stewart | 84/428 |
| 2,406,946 | 9/1946 | Firestone | 84/423 |
| 3,057,245 | 10/1962 | Lo Duca | 84/423 |
| 3,845,685 | 11/1974 | Coles | 84/423 |

FOREIGN PATENT DOCUMENTS

| | | | |
|---|---|---|---|
| 224,089 | 7/1910 | Germany | 84/428 |
| 7,184 | 4/1904 | United Kingdom | 84/424 |

OTHER PUBLICATIONS

Publication "The Pianoforte" by E. F. Rimbault Robt. Cocks & Co., London, 1860 p. 107.

*Primary Examiner*—Stephen J. Tomsky
*Attorney, Agent, or Firm*—Brown & Martin

[57] ABSTRACT

A keyboard for a piano, organ, or similar instrument in which the keys are arranged in groups of three, each having a pair of flat keys with a raised key inset between. The flat keys are on a common plane in the manner of the white keys of a conventional keyboard, the raised keys being short in length and spaced between the front edge of the flat keys and the back board of the instrument. In one form of the keyboard a second set of raised keys is positioned adjacent the backboard and mechanically coupled to the basic set of raised keys, so that either raised key in a pair may be used to play a particular note for the convenience of fingering. Four groups of three keys represent the twelve tones of the chromatic scale and a related notation system identifies each tone clearly, without the need for sharp and flat symbols. The keys also have a physical relationship to the note positions in the musical notation, which simplifies playing.

3 Claims, 8 Drawing Figures

KEYBOARD AND NOTATION SYSTEM

BACKGROUND OF THE INVENTION

This application is a continuation-in-part of an application entitled "Keyboard and Notation System," Ser. No. 557,592, filed Mar. 12, 1975, now abandoned.

In the conventional or Christofori type keyboard there are seven white keys and five raised black keys for each octave of the chromatic scale. The white keys represent the basic tones of the diatonic scale and the black keys represent the sharps and flats of the basic tones to make up the full twelve tone chromatic scale. The black keys are not symmetrically arranged in the octave group and twelve different fingering patterns must be learned in order to play the twelve major scales.

In the musical notation system using a five line staff, notes on a line or in a space between lines represent the basic tones, and symbols must be added to those notes for sharps and flats. Also, the notation for a particular tone in an octave is not always on a specific line or space in successive octaves, so the changing pattern for all octaves must be memorized.

SUMMARY OF THE INVENTION

In the keyboard described herein, the keys are in symmetrical and consistent groups of three, four such groups making one twelve tone octave. The keyboard is adaptable to existing pianos and similar instruments and is easily coupled to the conventional action, the operation and tuning of the instrument being unchanged. Only the physical arrangement of the keys and the fingering techniques are changed.

In each group of three keys two are flat and are on a common plane throughout the keyboard in the manner of conventional white notes. The third key in each group is centrally inset between the pair of flat keys and is raised in the manner of a conventional black key. However, instead of extending under the back board, the raised key is short in length and is situated between the back board and the front edge of the keyboard, so that the full width of each flat key is available in front of and behind the raised keys. In one form of the keyboard there are two sets of raised keys, each raised key having two raised sections on a common lever. One set of raised keys is spaced from the back board and the other, corresponding set, is immediately adjacent the back board. The flat keys are thus accessible in front of and between the sets of raised keys, allowing for very versatile fingering. The flat key representing the tone C in each octave is distinctively marked or colored for reference. The size and spacing of the keys and the span of an octave are similar to those in a conventional keyboard, so that hand motion and finger action is within normal capabilities.

In the notation system used with the keyboard, a basic four line staff is used instead of the usual five. For convenience, a double four line staff is used, with the first and fifth lines from the bottom made heavier, or otherwise marked, for ease of reading. A note on a line always represents a raised key, the same note being on the same staff line in any octave, so that only one pattern must be memorized. Each space between lines is used for two notes representing the flat keys. A note against the underside of a line represents the flat key immediately below that raised key on the keyboard. A note resting on top of a line represents the flat key immediately above that raised key. Thus each tone in an octave is represented by a specific note position, without the use of additional symbols for sharps, flats and naturals. The positioning of notes on a line, or above or below the line also has an easily recognizable physical relationship to a group of three keys and is consistent throughout the keyboard.

With this keyboard, all fingering is made in thirds and only three fingering patterns are needed to play all twelve major scales in an octave, compared to twelve different patterns on a conventional keyboard. It thus becomes a simple matter to transpose a piece of music learned in one key. By shifting the hands up and down the keyboard in thirds, a piece may be played in another key signature using the same fingering pattern.

The primary object of this invention, therefore, is to provide a new and improved keyboard for a musical instrument.

Another object of this invention is to provide a keyboard having keys arranged in symmetrical and consistent groups of three, with four such groups to an octave.

Another object of this invention is to provide a keyboard and an associated notation system, in which each key is represented by a distinctively positioned note.

A further object of this invention is to provide a keyboard and notation system, wherein the notation has a distinctive and consistent physical relationship to the keys in their groups of three.

Other object and advantages will be apparent in the following detailed description, taken in conjunction with the accompanying drawing, in which.

DESCRIPTION OF THE PREFERRED EMBODIMENT

Figure 1:
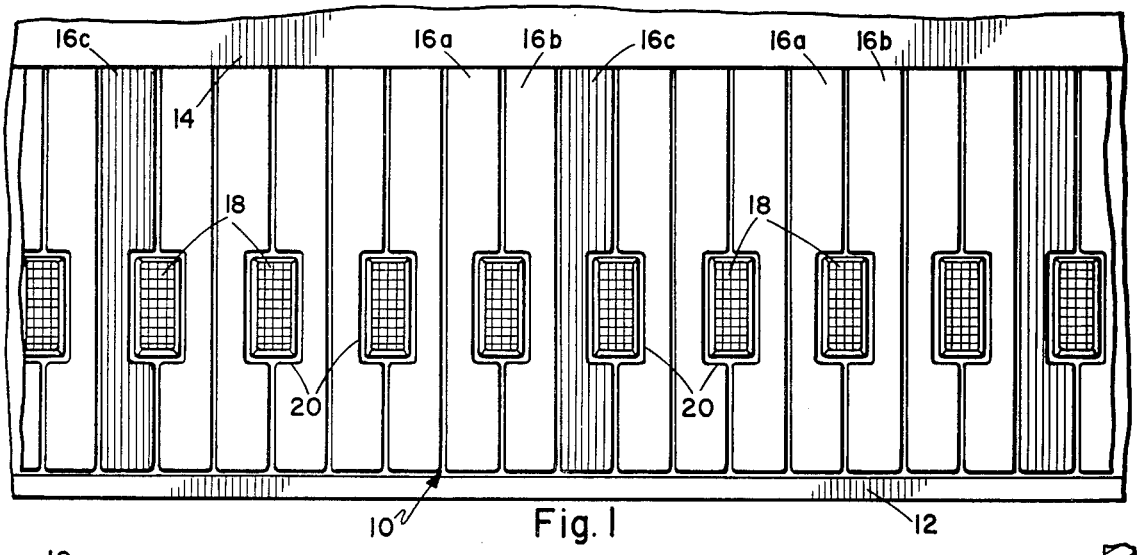
FIG. 1 is a top plan view of a portion of the keyboard.
Figure 2:
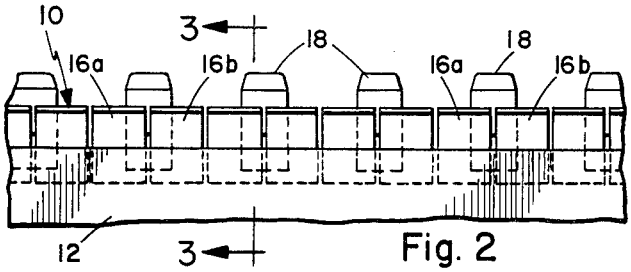
FIG. 2 is a front elevation view as taken from below FIG. 1.
Figure 3:
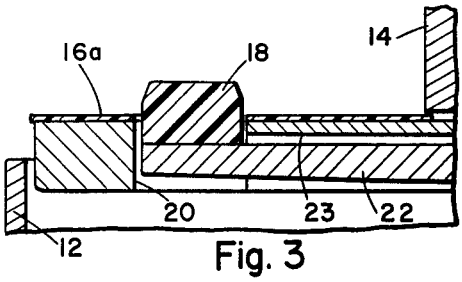
FIG. 3 is a sectional view taken on line 3—3 of FIG. 2.

The keyboard 10, illustrated in FIG. 1—3, is mounted in conventional structure of an instrument such as a piano, and extends between the front rail 12 and back board 14 of the structure. The keys include elongated flat keys 16 and raised keys 18, comparable to the white and black keys, respectively, of a conventional keyboard.

Each octave has twelve keys in four groups of three, each group including a pair of flat keys 16 and one raised key 18. The keys are similar in width to conventional keys, so that one octave occupies a standard hand span for ease of playing and to match the existing instrument action. Keys 16 are all in a common plane and extend under back board 14 for attachment in any suitable manner to the instrument action. Raised keys 18 are short in length and project upwardly through equal cut out portions 20 in the exposed portions of the associated pair of keys 16. The groups of three are thus symmetrical and the raised keys are equally spaced along the keyboard. For convenience the raised keys are spaced approximately midway between back board 14 and the front edge of the keyboard, so that the flat keys can be played in front of or behind the raised keys for added versatility. As illustrated, the raised keys 18 are slightly closer to the front edge for added leverage when used with a mechanical piano action, and are mounted on arms 22 which extend under the back board 14 for attachment to the action. Arms 22 are concealed beneath keys 16 in undercut channels 23. When the keyboard is used on an electrical instrument and leverage is not important, the raised keys can be centered in the keyboard if desired. The raised keys are shown as being of rectangular configuration, but could be of any other suitable form for decorative appearance.

For descriptive purposes, the flat keys 6 in each group of three keys will be designated 16*a* and 16*b.* In each octave the key representing the note C is distinctively marked or colored and will be designated 16*c.* Due to the symmetrical nature of the keyboard, it has been found that such marking is necessary, and the use of C as a reference makes the notation system more compatible with existing music. The raised keys may be colored or marked in any suitable manner for contrast and appearance.

Figure 4:
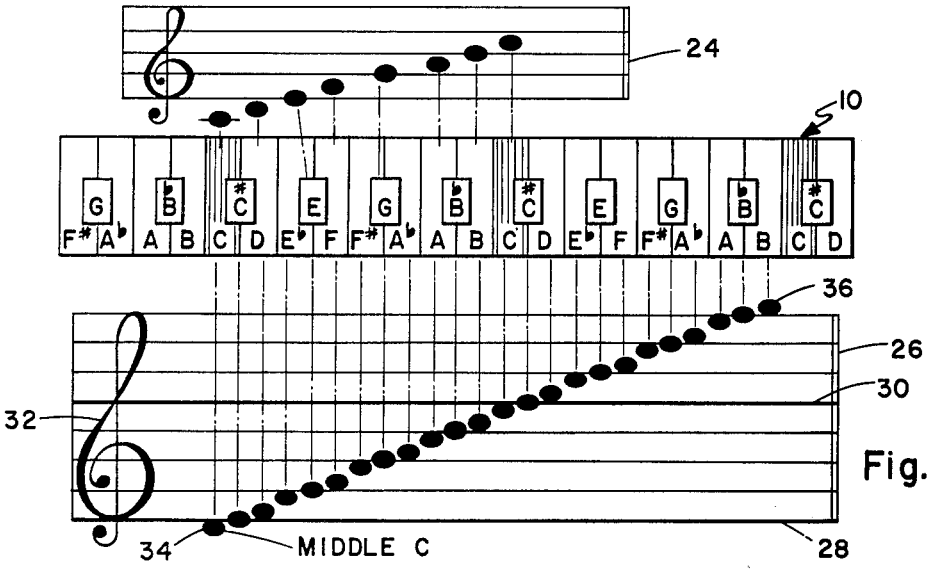
FIG. 4 illustrates the relationship of the special notation to the keyboard, conventional notation also being indicated for reference.

In FIG. 4, the keyboard 10 is illustrated in association with a conventional five line musical staff 24, on which the diatonic scale is marked. The note for middle C is on a line spaced below the bottom line of the staff, and the notes progress upwardly in spaces and on lines to the next C, which is in a space rather than on a line. Thus the positioning of notes relative to lines and spaces is not consistent and the entire notation system must be memorized. Also, the notes represent only the tones of the diatonic scale, and symbols must be used to designate sharps and flats in the full chromatic scale.

In the notation system adapted to the keyboard 10, a basic four line staff is used, on which a complete chromatic scale is represented. For convenience the actual music is written on a double staff 26 to encompass two octaves and avoid an excess of separate notes and lines outside the basic staff. In the double staff 26, the first line 28 and the fifth line 30, from the bottom, are made heavier for visual reference, or a color line may be added on or below these lines for visibility. The notes of the treble clef 32 are illustrated, starting from middle C at 34 and progressing upwardly for two octaves to B at 36. The bass clef would be similar but progressing downwardly from B below middle C.

Figure 5:
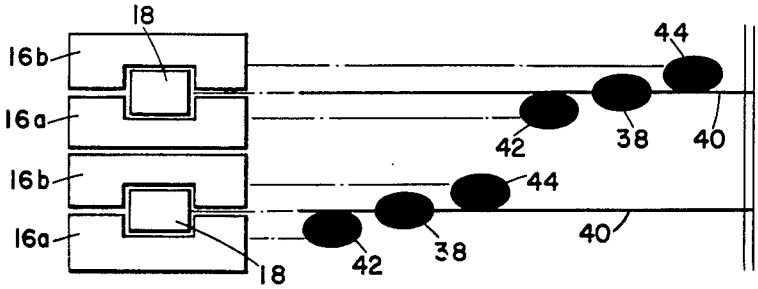
FIG. 5 illustrates the physical relationship of the notation to the key groups.

It can be seen that every note on the line of the staff represents a raised key 18 and that there are two notes between each pair of lines to designate the flat keys 16. The lines are spaced apart substantially further than the height of a note symbol, so that the note can be placed against the upper or lower line of a pair with a clear separation from the other line. A note against the underside of a line designates the flat key immediately below (in scale) the raised key which is identified by that line. Similarly, a note resting on top of a line designates the flat key immediately above the raised key identified by that line. This is more clearly illustrated in FIG. 5, in which the line spacing is greatly exaggerated for clarity. In each group of three keys in FIG. 5, note 38 on the line 40 represents the raised key 18. Note 42 below the line represents key 16*a* and note 44 above the line represents key 16*b.* This notation is consistent throughout the keyboard and the written music, so there can be no confusion as to the identity of notes. From FIG. 5 it can also be seen that there is a definite physical relationship of the notes above and below the line to the keys above and below the raised key in scale. In sight reading a piece of music, particularly by an inexperienced player, this has been found very helpful in clarifying note identification. In the actual staff the individual notes would occupy from one half to two thirds of the spacing between lines in order to leave a clear separation, as in FIG. 4.

Since each key and tone in the full chromatic scale is represented by an individual note on the staff, it is not necessary to know whether the tone is diatonic or sharp or flat. The conventional notation is shown on the keyboard for reference in FIG. 4, but the sharp and flat symbols are not used in the subject notation system. Other conventional musical symbols for time signature, note value, expression, accent and the like are used in the normal manner. It is thus a simple matter to convert existing music to the simplified notation system.

Since the keyboard is arranged entirely in thirds, only three fingering patterns need to be learned in order to play all twelve major scales in an octave. One other advantage of the keyboard of thirds is that it is a simple matter to transpose a piece of music from one key to another in thirds. Once a piece is known in one key, the hands can be moved up or down one or more note groups and, using the same fingering pattern, the piece can be played in three other key signatures.

Figure 6:
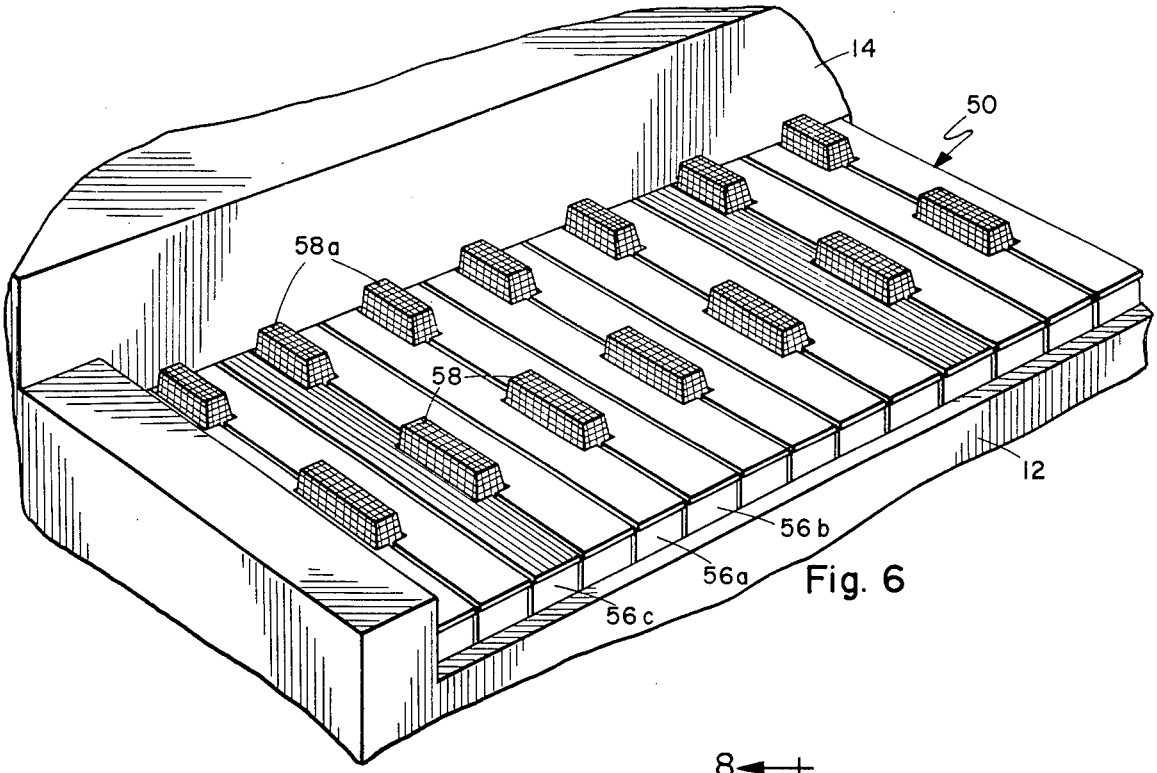
FIG. 6 is a perspective view of a modified keyboard with a second set of raised keys.
Figure 7:
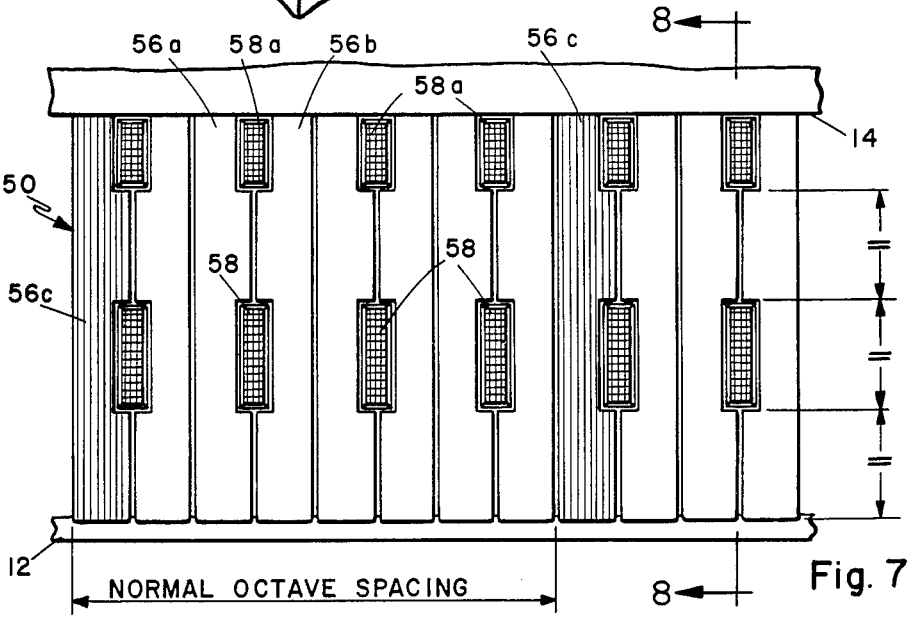
FIG. 7 is a top plan view of a portion of the keyboard of FIG. 6.
Figure 8:
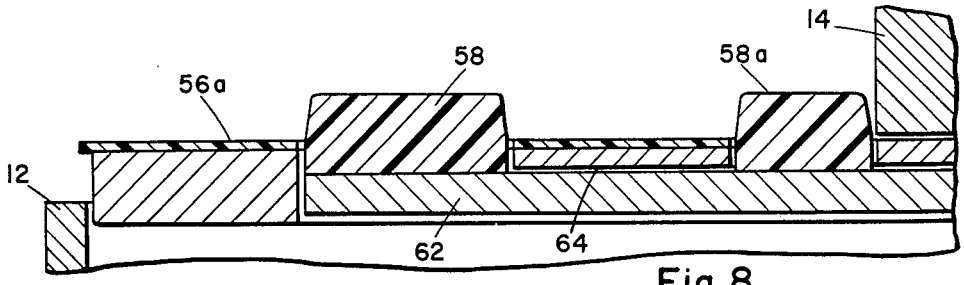
FIG. 8 is an enlarged sectional view taken on line 8—8 of FIG. 7.

Playing convenience is further improved by the keyboard 50, illustrated in FIGS. 6–8. The basic keyboard is as described above, but a second set of raised keys is added. Each group of three keys includes flat keys 56*a* and 56*b,* between which is a raised key 58 spaced forward of backboard 14. Each raised key 58 is fixed to a lever or arm 62 extending under the associated flat keys in a channel 64. On each arm 62 is a second raised key 58*a,* projecting upwardly immediately forward of backboard 14. Thus either portion 58 or 58*a* of a raised key may be depressed to sound the particular note.

The full width of the flat keys is available forward of raised keys 58 and between the raised keys 58 and 58*a.* As indicated in FIG. 7, the length of the raised key 58, the spacing from the front edge of the flat keys and the spacing between raised keys 58 and 58*a* are substantially equal. The raised keys 58*a* are somewhat shorter, about one half to two thirds of the length of raised keys 58. These proportions have been found to be the most convenient to fit into a keyboard of standard width, but may be varied if necessary. The octave group of four sets of three keys is also a standard octave width to fit conveniently on a conventional piano action.

It will be apparent that the keyboard with double raised keys permits a very versatile playing technique. The flat keys can be played in front of or behind the raised keys 58, and either raised key section may be used, depending on the convenience of finger positioning. This makes it unnecessary to double certain fingers under to reach raised keys and facilitates a more natural hand shape and motion. As in keyboard 10, the first key of each octave representing C in the scale, may be distinctively colored for reference as indicated by flat keys 56*c.*

In combination with the notation system, in which the keys and the notes are in groups of three, with clear visual and physical relationship, the learning and playing technique is greatly simplified. This relationship does not exist in conventional keyboards and notation. The visual and physical relationship enables a player to sight read and pick out a piece of music with a minimum of instruction and assitance, since the note progression is consistent and logical.

Having described my invention, I now claim:

1. A keyboard for use with a musical notation system in which the notes of an octave group representing a twelve tone chromatic scale are in four distinct groups of three, each group having one note on a line of a musical staff and the other two notes immediately above and below the line, the keyboard comprising:

a plurality of evenly spaced, elongated flat keys in a common plane in the keyboard, the flat keys being arranged in pairs and having forward ends and rearwardly extending portions;

a raised key projecting upwardly symmetrically between each pair of flat keys;

each pair of flat keys and the associated raised key forming a group of three, the raised key representing the note on the line of a three note group, and the pair of flat keys in the group representing the notes above and below the line of the related note group.

2. A keyboard according to claim 1, wherein said raised keys are shorter in length than the flat keys and are spaced between the front and rear portions thereof.

3. A keyboard according to claim 2, wherein said raised keys comprise a first set;

the keyboard including a second set of raised keys coupled to and spaced rearwardly from the first set, with the full width of the flat keys exposed forward of the first set and between the first and second sets of raised keys.

* * * * *